US006564809B1

(12) United States Patent
Resler

(10) Patent No.: US 6,564,809 B1
(45) Date of Patent: May 20, 2003

(54) NAIL CARE WAX COMPOSITION AND ASSOCIATED NAIL TREATMENT METHODS

(76) Inventor: Renee Resler, 6602 N. 31st St., Phoenix, AZ (US) 85016

( * ) Notice: Subject to any disclaimer, the term of this patent is extended or adjusted under 35 U.S.C. 154(b) by 0 days.

(21) Appl. No.: 09/839,922

(22) Filed: Apr. 20, 2001

(51) Int. Cl.[7] ..... A45D 29/11; A45D 29/00

(52) U.S. Cl. ..... 132/200; 132/73

(58) Field of Search ..... 132/200, 73, 73.5, 132/74.5; 424/401, 61; 428/482; 525/7, 7.1

(56) References Cited

U.S. PATENT DOCUMENTS

| | | | | |
|---|---|---|---|---|
| 3,885,578 A | | 5/1975 | Hicks | |
| 3,995,647 A | | 12/1976 | Kopfer | |
| 4,049,010 A | * | 9/1977 | Mitchell et al. | 132/200 |
| 4,249,551 A | | 2/1981 | Nordstrom | |
| 4,450,848 A | | 5/1984 | Ferrigno | |
| 4,587,983 A | | 5/1986 | Wissman et al. | |
| 4,669,491 A | | 6/1987 | Weisbert et al. | |
| 4,687,827 A | | 8/1987 | Russo | |
| 4,724,177 A | | 2/1988 | Russo | |
| 5,744,248 A | * | 4/1998 | Meixner et al. | 428/482 |
| 5,778,901 A | | 7/1998 | Abrahamian | |
| 6,080,414 A | * | 6/2000 | Smith, III et al. | 424/401 |
| 6,192,892 B1 | * | 2/2001 | Resler | 132/200 |

FOREIGN PATENT DOCUMENTS

| | | |
|---|---|---|
| DE | 4335527 A1 | 2/1994 |
| FR | 2415439 | 9/1979 |
| GB | 392982 | 9/1932 |

* cited by examiner

*Primary Examiner*—John J. Wilson
*Assistant Examiner*—Robyn Kieu Doan
(74) *Attorney, Agent, or Firm*—Parsons & Goltry; Michael W. Goltry; Robert A. Parsons

(57) ABSTRACT

A wax material and buffing element for use in buffingly applying a working amount of the wax material to a surface of a nail is disclosed. The wax material includes a hard wax component, a solvent component and an emulsifier component. The solvent has a high fugacity and flashes out in a buffing application of the wax material to the surface of a nail, leaving a very strong and rugged coating of wax upon the surface of the nail.

30 Claims, 1 Drawing Sheet

NAIL CARE WAX COMPOSITION AND ASSOCIATED NAIL TREATMENT METHODS

FIELD OF THE INVENTION

This invention relates to nail care products and methods and to improved compositions and methods for protecting and beneficially treating nail surfaces.

BACKGROUND OF THE INVENTION

Cosmetics are preparations that are applied to the human body for beautifying, preserving, or altering the appearance of, or for cleansing, coloring, conditioning, or protecting, skin, hair, nails, lips eyes or teeth. Since the advent of cosmetic preparations, skilled artisans have devoted considerable time and resources toward improving cosmetic preparation functionality, application systems and methods and containment structures. A particular field of cosmetics that enjoys a high degree of continuing innovation is that of nail care products and associated nail care methods. Although most of the innovation in the nail care field deal with improved color compositions and nail primers and manicuring tools, relatively little attention has been devoted toward compositions and methods, which are designed to improve nail health, to prevent nails from becoming dry and brittle and to enhance the luster and shine of nails without brush-on polishes. Given this lack of attention, the need for certain new and useful improvements directed toward nail treatment compositions and associated methods is evident.

SUMMARY OF THE INVENTION

The above problems and others are at least partially solved and the above purposes and others realized in a new and improved wax material including a hard wax component, a solvent component and an emulsifier component. The solvent has a high fugacity and flashes or otherwise evaporates out when applied to the surface of a nail in the form of a layer, leaving a very strong and rugged coating of wax upon the surface of the nail. The wax composition is usually contained in a receptacle, and it preferably incorporates 10–80 vol. % of the solvent component, 5–80 vol. % of the hard wax component, and 5–50 vol. % of the emulsifier component.

The hard wax component includes at least one of an insect wax, a vegetable wax and a petroleum wax. Included among the foregoing include carnuba wax, candelilla wax, synthetic jojoba wax, ceresine wax, ozokerite wax, paraffin wax, and synthetic microcrystallines. The solvent has a high fugacity and includes at least one of isohexadecane, isododecane, isooctane, isoeicosane, isoamylene, triisobutylene, cyclopantene, polybutene and hydrogenated polybutene. The emulsifier includes at least one of cetyl alcohol, cetyl stearyl alcohol, stearic acid, myristyl alcohol, cetyl lactate, cetyl palmitate, isopropyl palmitate, isopropyl lanolate, isopropyl myristate, octyl dodecanol, panthenol, lanolin, glyceryl monostearate, glycerin and vegetable glycerin. The wax material may also be furnished with a softener or softening agent, such as one or more of silicone, cyclomethicone, mineral oil, gelled mineral oil, vegetable oil, castor oil, hydrogenated castor oil, cashew nut oil, cottonseed oil, oil of sweet almond, palm oil, hemp seed oil and rectified oil of camphor. The wax material may still further incorporate a plasticizer, such as one or more of a phthalate plasticizer, an adiptate plasticizer, a sulfonamide plasticizer and a benzoate plasticizer, and a colorant, namely, at least one of an inorganic pigment and an organic pigment.

The receptacle containing the wax material may be one of a plurality of receptacles each containing wax material of a different color. The colors of the wax material contained in the receptacles may vary. The receptacles may be discrete or contained, supported or otherwise defined by a pallet or common support structure.

Consistent with the foregoing, the invention also provides methods of applying a protective coating to a nail surface. In a preferred embodiment, the invention proposes a method including steps of providing the wax material of the invention and applying a layer or coating of the wax material to a surface of a nail. In one embodiment, the step of applying includes providing buffing element, introducing a working amount of the wax material upon the surface of the nail, and buffingly acting on the working amount with the buffing element. In another embodiment, the step of applying includes introducing a working amount of the wax material onto the surface of the nail generally in the form of a layer, waiting for the solvent component to substantially evaporate from the layer, and buffingly acting on the layer with a buffing element.

BRIEF DESCRIPTION OF THE DRAWINGS

Referring to the drawing.

DETAILED DESCRIPTION OF A PREFERRED EMBODIMENT

Figure 1:
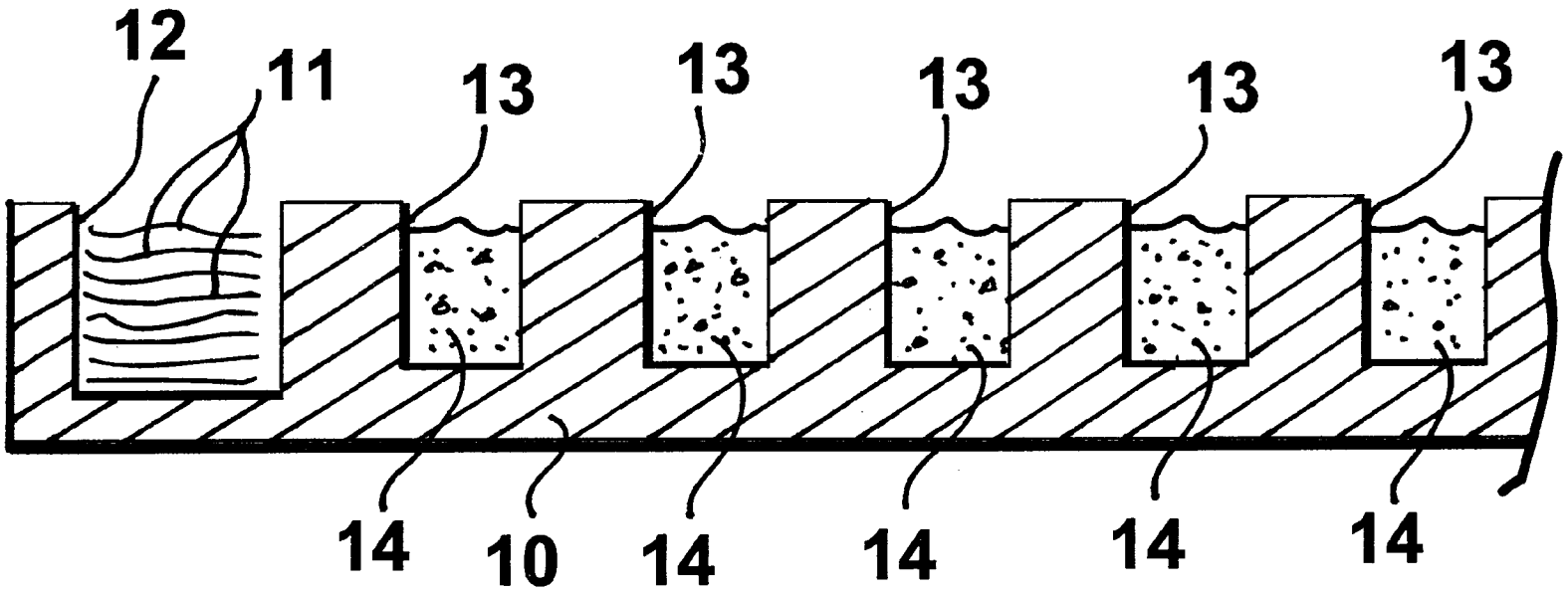
FIG. 1 illustrates a nail care system in accordance with the invention.

The present invention provides a wax material that when applied to the surface of the nail, protects, moisturizes and nourishes the nail. The wax material is preferably applied in a buffing application, such as with a buffing element. The buffing element is a soft cloth constructed of woven or unwoven natural and/or synthetic material. Other buffing devices may be used, including an elongate element made to substantially resemble a nail file and having a buffing surface or surfaces, etc. The buffing element is for use in buffingly applying a working amount of the wax material to a surface of a nail so as to form a protective coating and a plurality of coatings may be sequentially applied in accordance with the invention. The wax material is normally housed in a receptacle having a removable lid. The receptacle and lid are constructed of plastic, ceramic, etc., and the receptacle and lid incorporate structure for facilitating mutual snap, press, threaded or other desired form of detachable engagement, and the location of the mutual elements of removable attachment may be reversed.

In a particular embodiment, a buffing element and a receptacle containing the wax material of the invention is combined and provided as a kit contained in a bag, tote, purse, container or other container form for facilitating easy transport and storage. The receptacle containing the wax material may be discrete or contained, supported or otherwise defined by a pallet 10 as shown in FIG. 1 or other form of support structure. In the embodiment depicted in FIG. 1, pallet 10 is constructed and arranged to hold or otherwise contain buffing elements 11 and only one can be provided. In this embodiment, buffing elements 11 each include a sheet of soft cloth constructed of woven or unwoven natural and/or synthetic material, and pallet 10 includes containment structure 12 for holding or otherwise containing buffing elements 11. Each buffing element can be used repeatedly or discarded after use in applying a coating or coatings to a nail in accordance with the invention. Containment structure 12 is shown as a receptacle and more can be employed if desired. The receptacle containing the wax material may also be one of a plurality of receptacles 13 of pallet 10, each containing wax material 14. Wax material 14 of each of receptacles 13 may be colored in this embodiment, and the color of each wax material 14 of receptacles 13 is preferably different, i.e., varies in shade, hue or color. The wax material may also be contained within a deformable tub having an openable end, much like a tube of toothpaste. In another embodiment, the wax material may be contained within a tubular container and mounted in such a way so that it may be repeatedly extended and retracted relative to the container, much like conventional lipstick-type container arrangement. In accordance with the invention, the stiffness or softness of the wax material may be varied for allowing it to be squeezed from a tube or for allow it to hold a substantial shape.

The wax material is a mixture of a hard wax component, a solvent component and an emulsifier component. The hard wax component includes at least one of an insect wax, a vegetable wax and a petroleum wax. Included among the foregoing include one or more of carnuba wax and derivatives thereof, candelilla wax and derivatives thereof, synthetic jojoba wax, ceresine wax, ozokerite wax, paraffin wax, synthetic microcrystallines, beeswax and derivatives thereof, carnuba milk, bee's milk, orange wax, siliconyl beeswax such as that provided under the exemplary trademark CERA BELLINA®, siliconyl candelilla wax, hydroxy polyester wax, polyethylene wax, synthetic wax, poly alpha olefin wax, emulsifying wax, montan wax, wool wax, epicuticular wax, and fossil wax, and any other substantially similar wax or combination of waxes may also be employed. The solvent component of the wax material has a high fugacity in accordance with the invention and includes one of more of isohexadecane, isododecane, isooctane, isoeicosane, isoamylene, triisobutylene, cyclopantene, polybutene, and hydrogenated polybutene, and any other substantially similar solvent or combination of high fugacity solvents can be employed. The emulsifier component of the wax material includes one or more of cetyl alcohol, cetyl stearyl alcohol, stearic acid, myristyl alcohol, cetyl lactate, cetyl palmitate, isopropyl palmitate, isopropyl lanolate, isopropyl myristate, octyl dodecanol, panthenol, lanolin and derivatives thereof, glyceryl monostearate, glycerin, and vegetable glycerin, and any other substantially similar emulsifier or combination of emulsifiers can be employed. The wax material may also incorporate one or more softening agents, surfactants and moisturizers if desired.

The hard wax, solvent and emulsifier components are combined and heated to a temperature that is sufficient to melt them together into a uniform composition. The heating and mixing of the various components of the wax material of the invention is carried out in a series of heating and mixing steps. The solvent component of the wax material has a high fugacity and flashes out or otherwise evaporates in an application of a layer of the wax material to the surface of a nail, leaving a very strong, rugged and resilient coating of wax upon the surface of the nail.

The solvent component of the wax material softens the hard wax component so that it can be easily managed, and the emulsifier stabilizes the resulting wax material and increases spreadability. The wax, solvent and emulsifier components are provided in selected volume percentages, respectively, for causing the wax material to exhibit a desired manageability and a desired softness or stiffness as may be required for allowing the wax material to be easily squeezed from a squeeze tube, for allowing the wax material to be easily managed from a relatively small openable pot or basin or for allowing the wax material to maintain a substantial shape so that it may be packaged, contained and easily managed from a lipstick-type container/dispenser. The wax material includes 10–80 vol. % of the solvent component, 5–80 vol. % of the hard wax component, and 5–50 vol. % of the emulsifier component.

In a more specific and particularly exemplary embodiment, the wax material includes at least 21.1 vol. % of the hard wax component, at least 57.8 vol. % of the solvent component and at least 21.1 vol. % of the emulsifier component.

To enhance the ability of the hard wax component of the wax material of the invention to mix with or otherwise incorporate the emulsifier and solvent components, the wax material may be furnished with a plasticizer at a desired volume percent. Exemplary plasticizers include one or more of a phthalate plasticizer, an adiptate plasticizer, a sulfonamide plasticizer and a benzoate plasticizer.

As previously mentioned, the wax material may be furnished with one or more softening agents to enhance or otherwise facilitate a desired softness of the wax material. Exemplary softening agents include silicone, cyclomethicone, mineral oil, gelled mineral oil, vegetable oil such as olive oil, castor oil and hydrogenated castor oil, in addition to cashew nut oil, cottonseed oil, oil of sweet almond, palm oil, hemp seed oil, and rectified oil of camphor, and other suitable forms of nut, plant, seed and fruit oil can be employed. To provide the wax material in a desired color, a colorant is used. The colorant includes one or more of an inorganic pigment and an organic pigment. Regarding more specific embodiments, the inorganic pigment includes one of a group of colorants including titanium dioxide, iron oxide, manganese, ultramarine, ferric ferrocyanide, chromium oxide, chromium hydroxide, and bismuth oxychloride. The organic pigment includes one of a group including a D and C dye, an FD and C dye, an FD and C lake, an oil soluble D and C dye, and a D and C lake. Depending on specific needs, the inorganic pigment may include a blend of any two or more of the above group of inorganic pigments at desired volume percentages. The organic pigment may also include a blend of any two or more of the above group of organic pigments at desired volume percentages. The wax material of the invention may also incorporate any one or more of a talc colorant, a carmine colorant, a titanium oxide colorant, a mica colorant, etc.

To apply the wax material to a surface of a fingernail, a buffing element is taken up and massaged against the surface of the wax material for the purpose of introducing a working amount of the wax material onto the buffing element. The portion of the buffing element holding the working amount of the wax material is considered a working portion of the buffing element. The buffing element is then taken up and the surface of the nail is forcibly and buffingly acted upon with the working portion of the buffing element. The buffing action is important, as it serves to force portions of the wax material held by the working portion of the buffing element into the grooves, cavities, ridges and pockets naturally present on the surface of the nail and facilitates an application of a coating of the wax material upon the surface of the nail. Because the coating fills the grooves, cavities, ridges and pockets of the surface of the nail, the applied coating attaches to the nail surface aggressively leaving a desirably rich, smooth, polished and shiny appearance. Also, because solvent component of the wax material has a high fugacity, it flashes out or otherwise evaporates quickly in an application of a layer of the wax material to the surface of a nail, leaving a very strong, rugged and resilient coating of wax upon the surface of the nail. The applied layer protects the surface of the nail from scratching and seals in moisture, which helps prevent the nail as whole from becoming dry and brittle. Nail polish may be applied directly atop the coating.

The act of buffingly applying a coating of wax material upon a surface of a nail can involve introducing a working amount of the wax material upon the surface of the nail, such as with a finger or with the aid of applicator, and then buffingly acting on the working amount with a buffing element. The act of buffingly applying a coating of wax material upon a surface of a nail can also involve introducing a working amount of the wax material onto the surface of the nail generally in the form of a layer, waiting for the solvent component to substantially evaporate from the layer, and acting on the layer with a buffing element.

The wax material of the invention as disclosed herein is easy to apply to the surface of a fingernail in the form of an applied coating, which is desirably rich, smooth, polished and shiny and rugged, and which serves to protect the surface of the nail from scratching and seals in moisture, which helps prevent the nail as whole from becoming dry and brittle. Vitamins and minerals such as vitamin E and calcium may be added to the wax material of the invention for providing nutritional benefits to nails. The wax material is easy to buffingly apply and the bare nail surface does not need to be abraded prior to receiving a buffed coating of the wax material of the invention, and yet a user may abrade the surface of a nail prior to applying the wax material if so desired. Although the wax composition is best applied directly to a nail surface, it can be applied over nail polish.

Various changes and modifications to the embodiments herein chosen for the purpose of illustration will readily occur to those skilled in the art. To the extent that such modifications and variations do not depart from the spirit of the invention they are intended to be included within the scope of the invention as assessed only by a fair interpretation of the ensuing claims.

Having fully described the invention in such clear and concise terms as to enable those skilled in the art to understand and practice the same, the invention claimed is:

What is claimed is:

1. Apparatus comprising:

a receptacle containing a wax material comprising 10–80 vol. % of a fugacious solvent component, 5–80 vol. % of a hard wax component and 5–50 vol. % of an emulsifier component; and a buffing element for use in buffingly applying a working amount of the wax material to a surface of a nail.

2. Apparatus of claim 1, wherein the wax material includes at least one of an insect wax, a vegetable wax and a petroleum wax.

3. Apparatus of claim 1, wherein the wax material includes at least one of carnuba wax and derivatives thereof, candelilla wax and derivatives thereof, synthetic jojoba wax, ceresine wax, ozokerite wax, paraffin wax, synthetic microcrystallines, beeswax and derivatives thereof, carnuba milk, bee's milk, orange wax, siliconyl beeswax, siliconyl candelilla wax, hydroxy polyester wax, polyethylene wax, synthetic wax, poly alpha olefin wax, emulsifying wax, montan wax, wool wax, epicuticular wax, and fossil wax.

4. Apparatus of claim 1, wherein the wax material includes a solvent.

5. Apparatus of claim 4, wherein the solvent comprises at least one of isohexadecane, isododecane, isooctane, isoeicosane, isoamylene, triisobutylene, cyclopantene, polybutene and hydrogenated polybutene.

6. Apparatus of claim 1, wherein the wax material includes an emulsifier.

7. Apparatus of claim 6, wherein the emulsifier comprises at least one of cetyl alcohol, cetyl stearyl alcohol, stearic acid, myristyl alcohol, cetyl lactate, cetyl palmitate, isopropyl palmitate, isopropyl lanolate, isopropyl myristate, octyl dodecanol, panthenol, lanolin, glyceryl monostearate, glycerin and vegetable glycerin.

8. Apparatus of claim 1, wherein the wax material includes a softener.

9. Apparatus of claim 8, wherein the softener comprises at least one of silicone, cyclomethicone, mineral oil, gelled mineral oil, vegetable oil, castor oil, hydrogenated castor oil, cashew nut oil, cottonseed oil, oil of sweet almond, palm oil, hemp seed oil and rectified oil of camphor.

10. Apparatus of claim 1, wherein the wax material includes a plasticizer.

11. Apparatus of claim 10, wherein the plasticizer comprises at least one of a phthalate plasticizer, an adiptate plasticizer, a sulfonamide plasticizer and a benzoate plasticizer.

12. Apparatus of claim 1, wherein the wax material includes a colorant.

13. Apparatus of claim 12, wherein the colorant comprises at least one of an inorganic pigment and an organic pigment.

14. Apparatus comprising:

receptacles each containing a colored wax material, wherein the color of the wax material composition of each of the receptacles is different;

the wax material of each of the receptacles comprising 10–80 vol. % of a fugacious solvent component, 5–80 vol. % of a hard wax component and 5–50 vol. % of an emulsifier component; and a buffing element for use in buffingly applying a working amount of the wax material of a selected one of the receptacles to a surface of a nail.

15. Apparatus of claim 14, wherein the wax material of each of the receptacles includes at least one of an insect wax, a vegetable wax and a petroleum wax.

16. Apparatus of claim 14, wherein the wax material of each of the receptacles includes at least one of carnuba wax and derivatives thereof, candelilla wax and derivatives thereof, synthetic jojoba wax, ceresine wax, ozokerite wax, paraffin wax, synthetic microcrystallines, beeswax and derivatives thereof, carnuba milk, bee's milk, orange wax, siliconyl beeswax, siliconyl candelilla wax, hydroxy polyester wax, polyethylene wax, synthetic wax, poly alpha olefin wax, emulsifying wax, montan wax, wool wax, epicuticular wax, and fossil wax.

17. Apparatus of claim 14, wherein the wax material of each of the receptacles includes a solvent.

18. Apparatus of claim 17, wherein the solvent comprises at least one of isohexadecane, isododecane, isooctane, isoeicosane, isoamylene, triisobutylene, cyclopantene, polybutene and hydrogenated polybutene.

19. Apparatus of claim 14, wherein the wax material of each of the receptacles includes an emulsifier.

20. Apparatus of claim 19, wherein the emulsifier comprises at least one of cetyl alcohol, cetyl stearyl alcohol, stearic acid, myristyl alcohol, cetyl lactate, cetyl palmitate, isopropyl palmitate, isopropyl lanolate, isopropyl myristate, octyl dodecanol, panthenol, lanolin, glyceryl monostearate, glycerin and vegetable glycerin.

21. Apparatus of claim 14, wherein the wax material of each of the receptacles includes a softener.

22. Apparatus of claim 21, wherein the softener comprises at least one of silicone, cyclomethicone, mineral oil, gelled mineral oil, vegetable oil, castor oil, hydrogenated castor oil, cashew nut oil, cottonseed oil, oil of sweet almond, palm oil, hemp seed oil and rectified oil of camphor.

23. Apparatus of claim 14, wherein the wax material of each of the receptacles includes a plasticizer.

24. Apparatus of claim 23, wherein the plasticizer comprises at least one of a phthalate plasticizer, an adiptate plasticizer, a sulfonamide plasticizer and a benzoate plasticizer.

25. Apparatus of claim 14, wherein the wax material of each of the receptacles includes a colorant.

26. Apparatus of claim 25, wherein the colorant comprises at least one of an inorganic pigment and an organic pigment.

27. A method of applying a protective coating to a nail surface comprising steps of:

providing a wax material comprising 10–80 vol. % of a fugacious solvent component, 5–80 vol. % of a hard wax component and 5–50 vol. % of an emulsifier component; and buffingly applying a layer of the wax material to a surface of a nail.

28. The method of claim 27, wherein the step of buffingly applying further includes steps of:

providing buffing element;

placing a working amount of the wax material upon the surface of the nail; and buffingly acting on the working amount with the buffing element.

29. The method of claim 27, wherein the step of buffingly applying further includes steps of:

introducing a working amount of the wax material onto the surface of the nail in the form of a layer;

waiting for the layer to substantially dry; and buffingly acting on the layer with a buffing element.

30. A method of applying a protective coating to a nail surface comprising steps of:

providing a wax material including a hard wax component and a fugacious solvent component;

introducing a working amount of the wax material onto a surface of a nail in the form of a layer;

waiting for the fugacious solvent component to substantially evaporate from the layer; and buffingly acting on the layer with a buffing element.

* * * * *